US008471688B2

(12) United States Patent
Preston et al.

(10) Patent No.: US 8,471,688 B2
(45) Date of Patent: Jun. 25, 2013

(54) GUNFIRE SOUND SYSTEM

(75) Inventors: Steven Preston, Winter Springs, FL (US); Edward S. Kaprocki, Debary, FL (US); Tom Penner, Apopka, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 437 days.

(21) Appl. No.: 12/906,610

(22) Filed: Oct. 18, 2010

(65) Prior Publication Data

US 2012/0092145 A1 Apr. 19, 2012

(51) Int. Cl.
*G08B 3/00* (2006.01)

(52) U.S. Cl.
USPC ..... 340/398.1; 340/815.7; 340/384.3

(58) Field of Classification Search
USPC ..... 340/398.1, 407.1, 407.2, 815.7, 384.1, 340/384.3, 390.1, 390.2, 392.1, 392.2; 434/18, 434/21; 119/719; 102/302, 355; 124/74; 446/404, 420; 42/71.01
See application file for complete search history.

(56) References Cited

U.S. PATENT DOCUMENTS

| | | | | |
|---|---|---|---|---|
| 5,326,303 | A * | 7/1994 | D'Andrade | 446/407 |
| 6,010,389 | A * | 1/2000 | Terll | 446/404 |
| 2002/0092864 | A1 * | 7/2002 | Small et al. | 222/79 |
| 2003/0116100 | A1 * | 6/2003 | Cullen | 119/719 |

* cited by examiner

*Primary Examiner* — Daryl Pope
(74) *Attorney, Agent, or Firm* — Schwegman Lundberg & Woessner, P.A.

(57) ABSTRACT

A device includes a housing and a hammer. A motor is coupled to the hammer to move the hammer away from a side of the housing and release the hammer. A tension spring is coupled to the hammer to cause the hammer to strike the housing after the hammer is moved away from the housing by the motor and released. The housing acts as a sounding device to simulate the sound of gunfire.

20 Claims, 2 Drawing Sheets

GUNFIRE SOUND SYSTEM

BACKGROUND

Speaker systems can be low cost, but designing a low frequency heavy air mover for gunfire simulation can be an expensive proposition. Size constrictions may dictate a non-circular speaker patter, which can further increase the cost.

SUMMARY

A device includes a housing and a hammer. A motor is coupled to the hammer to move the hammer away from a side of the housing and release the hammer. A tension spring is coupled to the hammer to cause the hammer to strike the housing after the hammer is moved away from the housing by the motor and released. The housing acts as a sounding device to simulate the sound of gunfire.

In a further embodiment, a motor is coupled to the hammer to move the hammer away from a side of the housing and release the hammer. A tension spring is coupled to the hammer to cause the hammer to strike the housing after the hammer is moved away from the housing by the motor and released, such that the housing acts as a sounding device to simulate the sound of gunfire.

In one embodiment, a method includes receiving a firing cue. The hammer within the container is moved a desired distance from a side of the container. A spring coupled to the hammer is tensioned when the hammer is moved from the side of the container. The hammer is released such that the spring causes the hammer to strike the side of the container, using the container as a sounding device to simulate gunfire sound.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Figure 1:
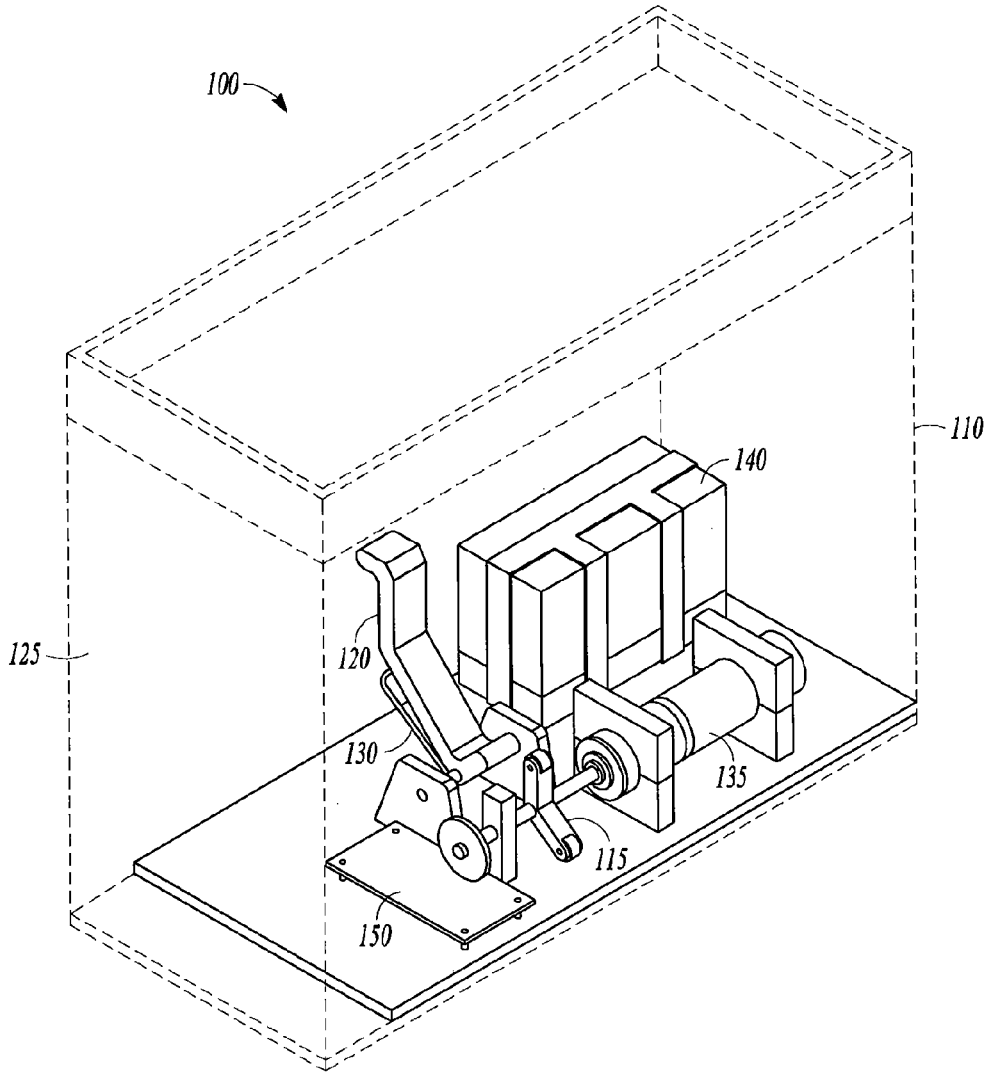
FIG. 1 is transparent perspective view of a device for simulating gunfire sound according to an example embodiment.

FIG. 1 is transparent perspective view of a device 100 for simulating gunfire sound. A housing 110, such as a metal ammo can may be sealed from water. The housing secures a moveable gear 115 that is coupled to move a pendulum hammer 120 away from a side 125 of the housing 110. A tension spring 130 is coupled to the hammer 120 and provides force on the hammer to move it quickly toward the side 125 when the moveable gear moves the hammer back a desired distance.

The gear in one embodiment is operable to move the pendulum hammer back from a side of the housing to tension the tension spring and to release the pendulum hammer when the pendulum hammer is moved back a desired distance. The tension spring is used to cause the pendulum hammer to strike the housing such that the housing acts as a sounding device to simulate the sound of gunfire. In one embodiment, the gear has three teeth that move the hammer back and release the hammer when the teeth rotate past a predetermined angle.

A motor 135 is coupled to the gear 115 and operates from a power source, such as a battery 140. In further embodiments, the motor is coupled to, or has an integrated arm or other mechanical structure to move and release the hammer in a desired manner. In one embodiment, the motor is geared to about 600 RPM to provide a fast strike when activated. In still further embodiments, the power source may be a fuel cell, compressed air, or other type of power storage device capable of moving the hammer in a desired manner.

Figure 2:
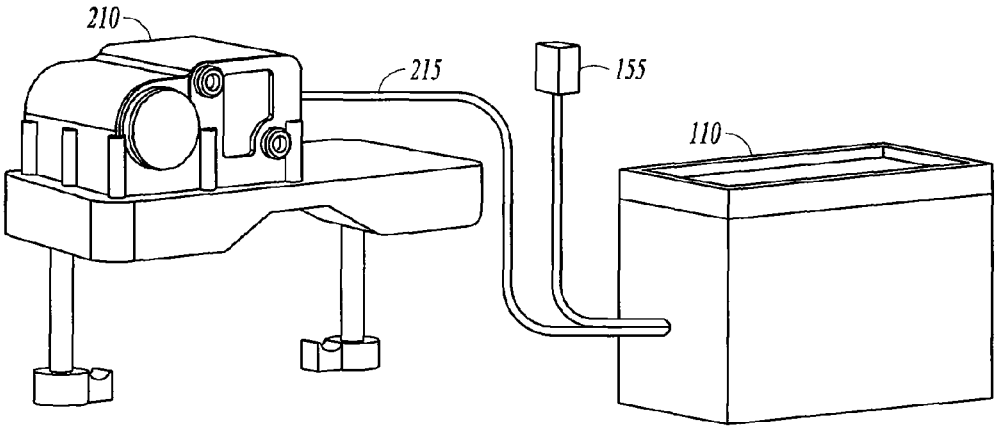
FIG. 2 is a block representation of a system for simulating gunfire sound according to an example embodiment.

Control circuitry 150 may also be positioned inside the housing 110, and provides control of the motor 135, and also receives signals representative of simulated gunfire such as from a training weapon equipped with a laser transmitter 210 in FIG. 2 to simulate weapon firing. The laser transmitter may have a wired connection 215 to the circuitry in container 110, and may also transmit firing cues wirelessly for receipt by those nearby the person firing the weapon. In one embodiment, the control circuitry 150 includes a wireless receiver 155 to receive wireless signals from the training weapon or other weapons nearby when fired. Upon receipt of the signals, the controller causes the motor to initiate a housing strike by the hammer. In addition to storing energy for the hammer strike, the spring may operate to cause the hammer to maintain contact with the side of the container after striking the side of the container to reduce high frequency emissions.

Figure 3:
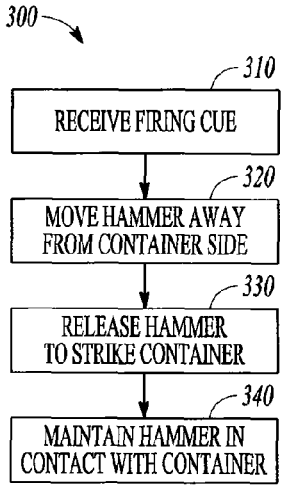
FIG. 3 is a flow chart describing a method of simulating gunfire sound according to an example embodiment.

A method 300 of simulating gunfire is illustrated in FIG. 3 in flowchart form. At 310, the device 100 receives a firing cue. In response to the firing cue, a hammer within the container 115 is moved a desired distance from the side 125 of the container at 320. The spring 120 coupled to the hammer is tensioned when the hammer is moved from the side of the container, in effect storing energy. The hammer is released at 330 such that the spring causes the hammer to strike the side of the container, using the container as a sounding device to simulate gunfire sound. At 340, the hammer is maintained in contact with the side of the container after the hammer strikes the side of the container. In one embodiment, the motor is geared to allow many strikes per second consistent with the firing capability of weapons to be simulated.

The Abstract is provided to comply with 37 C.F.R. §1.72(b) is submitted with the understanding that it will not be used to interpret or limit the scope or meaning of the claims.

The invention claimed is:

1. A device comprising:

a housing;

a moveable gear secured in the housing;

a pendulum having a pendulum hammer coupled to the moveable gear; and a tension spring to cause the pendulum hammer to strike the housing such that the housing acts as a sounding device to simulate the sound of gunfire.

2. The device of claim 1 wherein the housing is water sealable.

3. The device of claim 1 and further comprising:

an electrical power source; and a motor coupled to the electrical power source and the moveable gear.

4. The device of claim 3 wherein the gear is operable to move the pendulum hammer back from a side of the housing to tension the tension spring and to release the pendulum hammer when the pendulum hammer is moved back a desired distance.

5. The device of claim 4 and further comprising circuitry to receive firing cues and control the motor to cause a hammer strike.

6. The device of claim 3 wherein the motor is geared to about 600 RPM.

7. The device of claim 1 wherein the hammer maintains contact with the side of the container after striking the side of the container to reduce high frequency emissions.

8. The device of claim 1 wherein the housing comprises an ammo can.

9. A device comprising:

a housing;

a hammer;

a motor coupled to the hammer to move the hammer away from a side of the housing and release the hammer; and a tension spring coupled to the hammer to cause the hammer to strike the housing after the hammer is moved away from the housing by the motor and released, such that the housing acts as a sounding device to simulate the sound of gunfire.

10. The device of claim 9 wherein the housing is water sealable.

11. The device of claim 9 and further comprising an electrical power source coupled to the motor.

12. The device of claim 11 wherein the motor is coupled to a gear to move the hammer back from a side of the housing to tension the tension spring and to release the hammer when the hammer is moved back from the side of the housing a desired distance.

13. The device of claim 12 and further comprising circuitry to receive firing cues and control the motor to cause a hammer strike.

14. The device of claim 13 wherein the circuitry comprises a wireless receiver.

15. The device of claim 9 wherein the hammer maintains contact with the container after striking the container to reduce high frequency emissions.

16. The device of claim 9 wherein the housing comprises an ammo can.

17. A method comprising:

receiving a firing cue;

moving a hammer within a container a desired distance from a side of the container;

tensioning a spring coupled to the hammer when the hammer is moved from the side of the container; and releasing the hammer such that the spring causes the hammer to strike the side of the container, using the container as a sounding device to simulate gunfire sound.

18. The method of claim 17 wherein the hammer is moved by a striker gear coupled to a motor.

19. The method of claim 18 wherein the spring is a torsion spring.

20. The method of claim 17 and further comprising maintaining contact between the hammer and the side of the container after the hammer strikes the side of the container.

* * * * *